US006048173A

United States Patent [19]

Chen

[11] Patent Number: 6,048,173

[45] Date of Patent: Apr. 11, 2000

[54] ENGAGEMENT OF BLADE BRACKETS AND THE MOTOR CASING FOR A CEILING FAN

[75] Inventor: Huang-Jia Chen, Chang Hua, Taiwan

[73] Assignee: Huang-Jie Tsai, Chang Huan, Taiwan

[21] Appl. No.: 09/225,691

[22] Filed: Jan. 6, 1999

[51] Int. Cl.[7] ..... F04D 29/34

[52] U.S. Cl. ..... 416/210 R; 416/5; 416/206; 416/220 A; 416/221

[58] Field of Search ..... 416/5, 204 R, 416/206, 207, 208, 210 R, 220 A, 221

[56] References Cited

U.S. PATENT DOCUMENTS 2,846,183 8/1958 Morgan ..... 416/221
5,927,945 7/1999 Chen ..... 416/5
5,980,353 11/1999 Wu ..... 416/210 R

*Primary Examiner*—Christopher Verdier
*Attorney, Agent, or Firm*—Bacon & Thomas

[57] ABSTRACT

A ceiling fan includes a motor casing with an engaging ring connected to the bottom of the motor casing, the engaging ring having a plurality of tapered recesses defined in the bottom thereof and each of the recesses having an open end in the inner periphery of the ring and a closed end on the outside of the ring. Each of the recesses has two grooves defined in the two sides thereof. Each of the fan blade brackets has two flanges to be received in the grooves. The first end of each of the end members is stopped by the closed end of the recess. A plurality of balls movably received in the ring and the balls respectively extend into the respective recesses so as to contact the second end of the end members in the recesses.

3 Claims, 6 Drawing Sheets

ENGAGEMENT OF BLADE BRACKETS AND THE MOTOR CASING FOR A CEILING FAN

FIELD OF THE INVENTION

The present invention relates to an engagement of the blade brackets and a motor casing for a ceiling fan, the motor casing having an engaging ring which has a plurality of tapered recesses for engaging with the respective end members of the fan blades, and a plurality of balls embedded in the ring and extending in the recesses to contact the end members.

BACKGROUND OF THE INVENTION

FIG. 6 shows a conventional fan blade 20 and the motor casing 10 of a ceiling fan, the motor casing 10 having a plurality of pairs of holes 11 defined therethrough and each of the blade brackets 21 of the fan blades 20 has two apertures 22 so that bolts 12 extend through the two apertures 22 and engage with the holes 11 in the motor casing 10. It takes time to assemble each of the fan blades 20 to the motor casing 10 and requires a lot of bolts 12. Besides, when the users want to clean these fan blades 20, the bolts 12 have to be loosened one by one. Furthermore, when engaging the bolts 12 with the holes 11, some of the bolts 12 could be positioned inclinedly, and this will make the fan blades 20 to be located at unexpected positions which could affect the balance of the fan blades.

The present invention intends to provide a simple structure to connect fan blades to the motor casing without using bolts. Therefore, the present invention has arisen to mitigate and/or obviate the disadvantage of the conventional engagement of the fan blade brackets and the engaging ring on the motor casing.

SUMMARY OF THE INVENTION

In accordance with one aspect of the present invention, there is provided a ceiling fan comprising a motor casing with an engaging ring connected to the bottom thereof. The engaging ring has a plurality of recesses defined in the bottom thereof and each of the recesses has an open end in the inner periphery of the engaging ring and a closed end on the outside of the engaging ring. Each of the recesses has two grooves defined in the two sides thereof. A plurality of apertures are defined through the engaging ring and respectively communicate with the respective recesses. Each of the apertures has a spring and a ball received therein, the balls respectively extending into the recesses through the apertures.

A plurality of fan blade brackets each have an end member which has two flanges to be received in the two grooves of the recess corresponding thereto. The first end of each of the end members contacts the closed end of the recess corresponding thereto and the second end of each of the end members is stopped by the ball.

It is an object of the present invention to provide an engagement of the fan blade brackets and the motor casing, wherein the fan blade brackets are easily positioned by simply being inserted into the recesses of the engaging ring.

Further objects, advantages, and features of the present invention will become apparent from the following detailed description with appropriate reference to the accompanying drawings.

DETAILED DESCRIPTION OF THE PREFERRED EMBODIMENT

Figure 1:
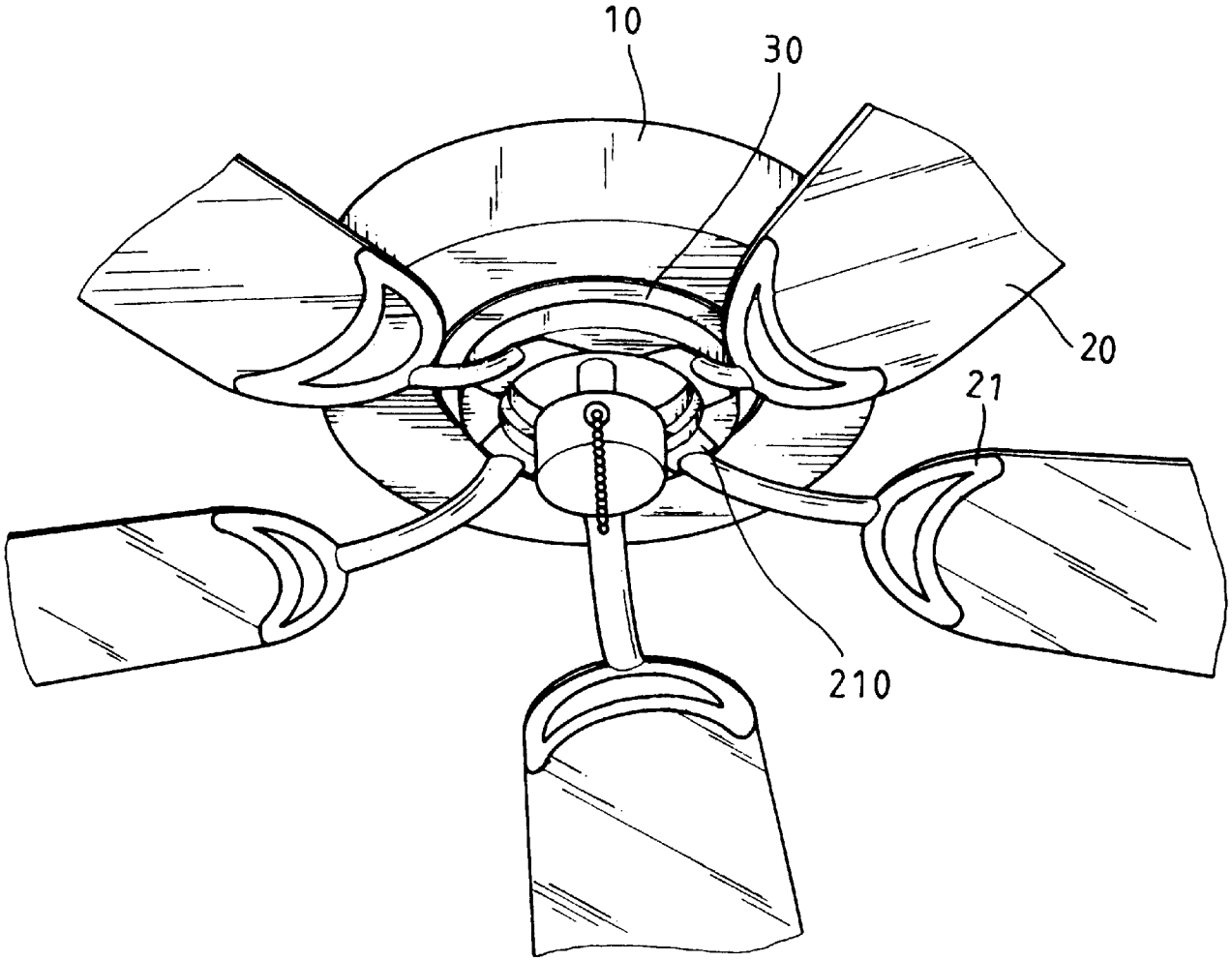
FIG. 1 is a bottom perspective view of the ceiling fan in accordance with the present invention.
Figure 2:
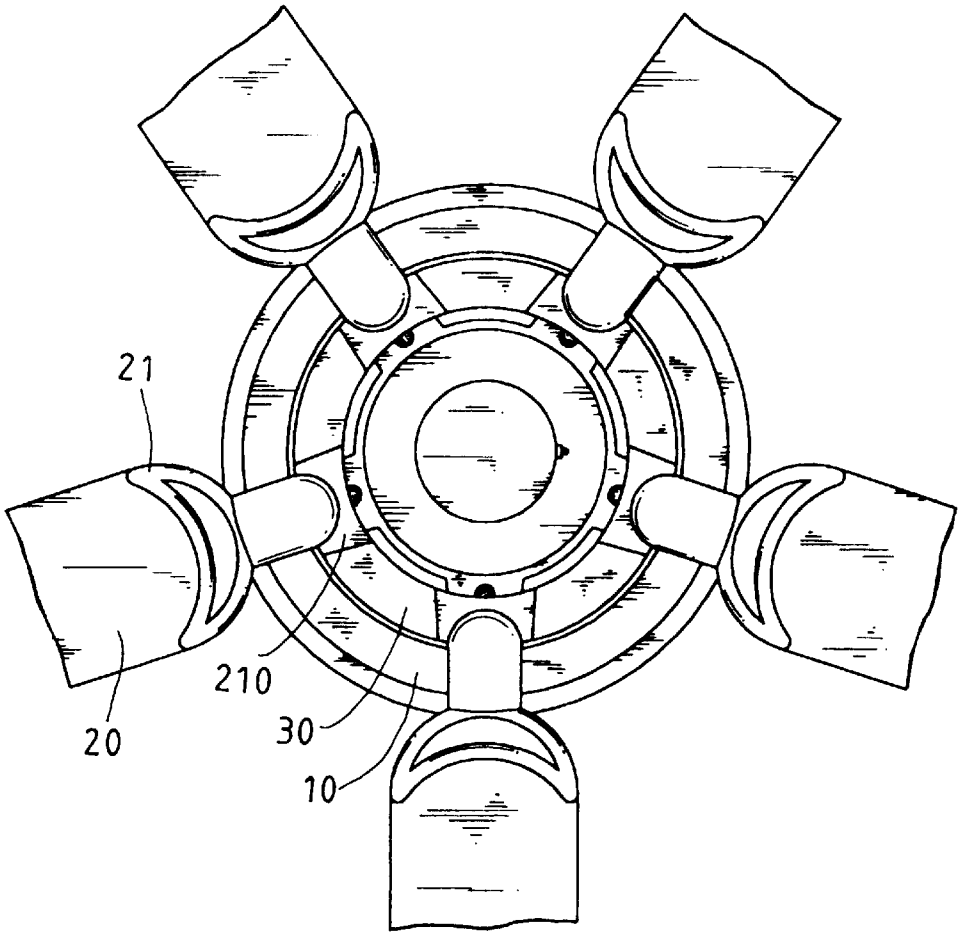
FIG. 2 is a bottom plan view to show the ceiling fan of the present invention.
Figure 3:
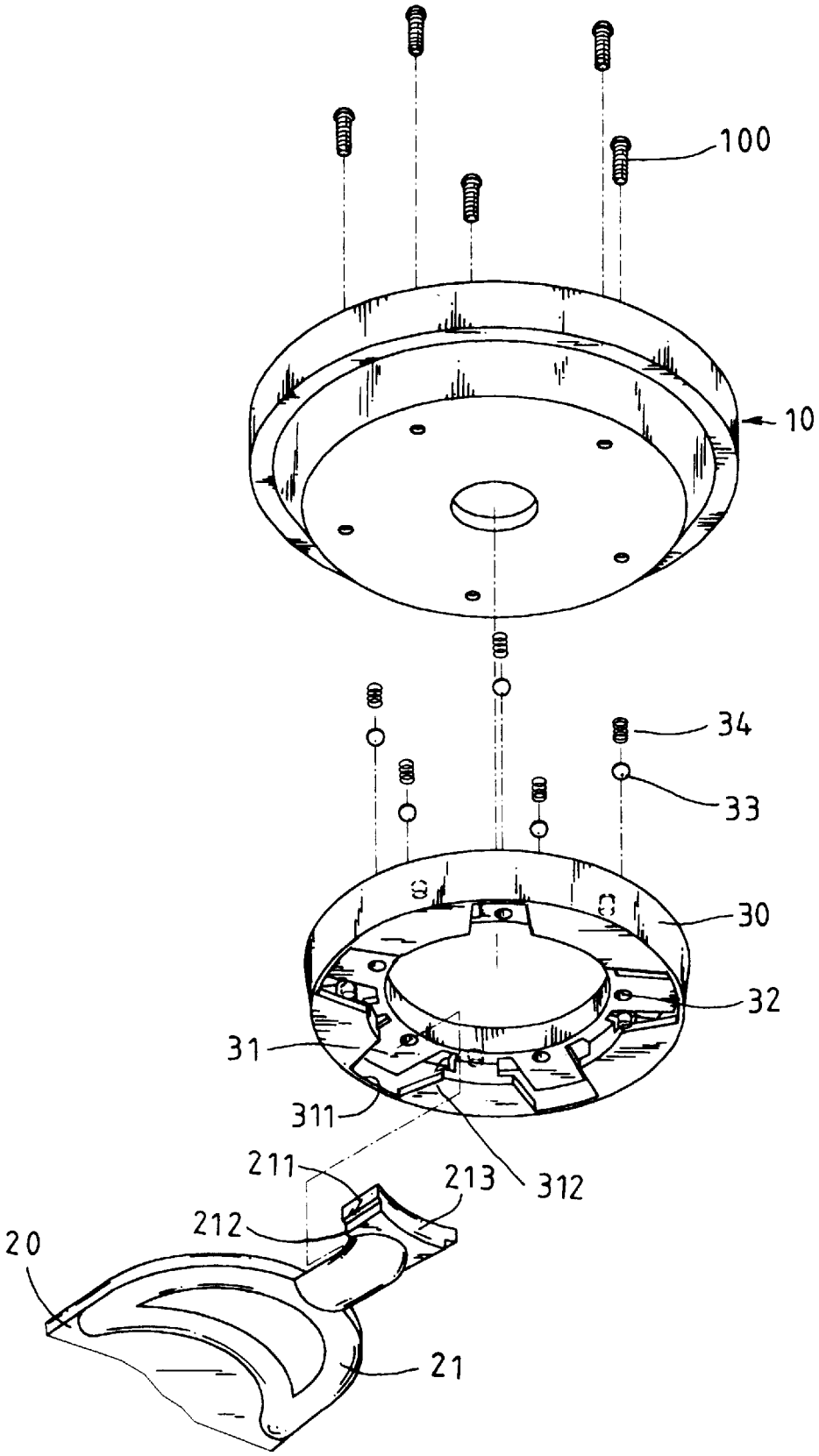
FIG. 3 is an exploded view of the motor casing, the engaging ring and a fan blade bracket in accordance with the present invention.

Referring to FIGS. 1 to 4, the ceiling fan in accordance with the present invention comprises a motor casing 10 which has an engaging ring 30 connected to the bottom thereof by bolts 100. The engaging ring 30 has a plurality of tapered recesses 31 defined in the bottom thereof and each of the recesses 31 has an open end defined in the inner periphery of the engaging ring 30 and a closed end on the outside of the engaging ring 30. Each of the recesses 31 has two grooves 312 defined in the two sides thereof. A plurality of apertures 32 are defined through the engaging ring 30 and respectively communicate with the respective recesses 31, wherein each of the apertures 32 has a spring 34 and a ball 33 received therein which is biased by the spring 34. Therefore, the springs 34 are urged between the balls 33 and the bottom of the motor casing 10. Each of the apertures 32 are a tapered aperture so that a part of the ball 33 in the aperture 32 movably extends into the recess 31 corresponding thereto.

Figure 4:
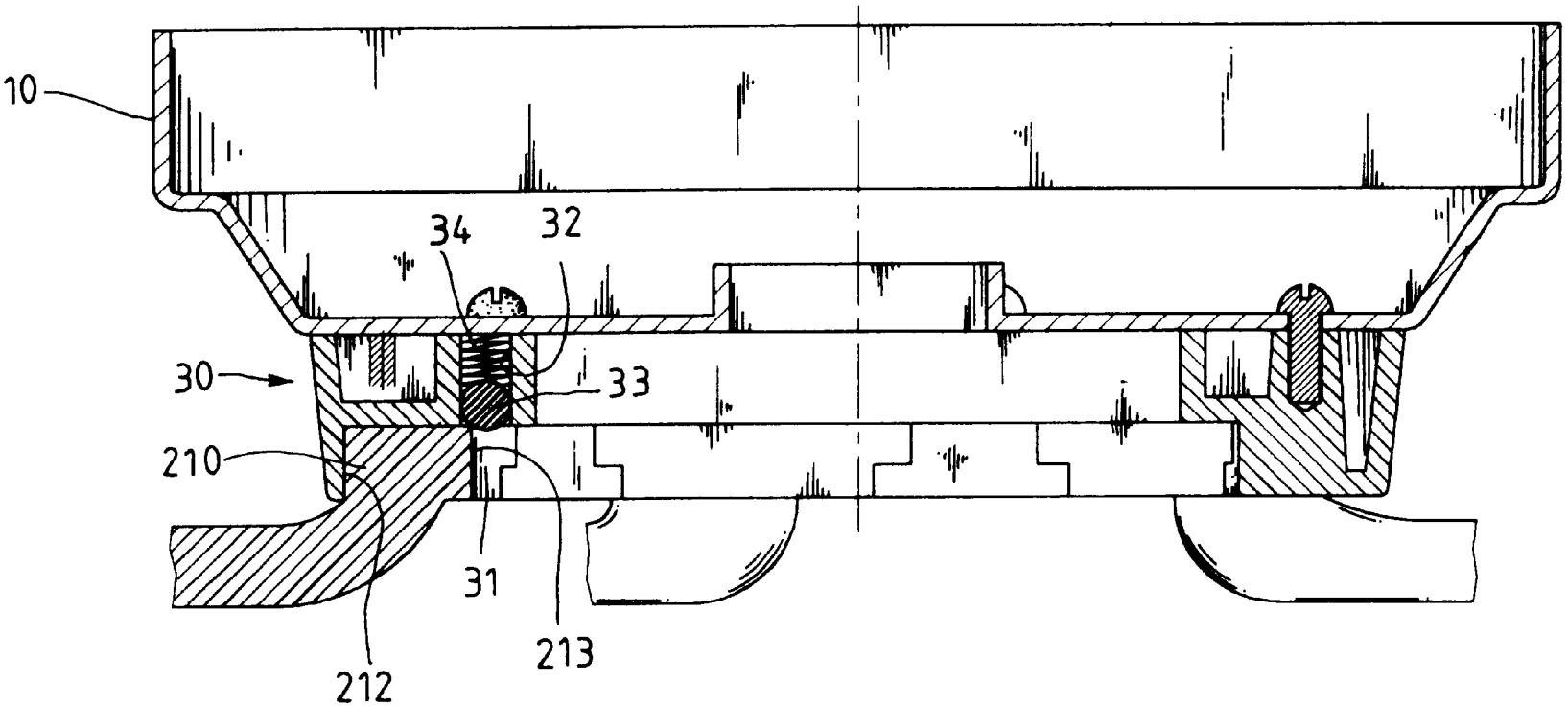
FIG. 4 is a side elevational view, partly in section, of the fan blade bracket positioned in the recess of the engaging ring in accordance with the present invention.

A plurality of fan blade brackets 21 each have a fan blade 20 connected to the first end thereof and a rod extending from the second end thereof. An end member 210 is fixedly connected to each of the rods and has two flanges 211 extending from two sides thereof so as to be received in the two grooves 312 of the recess 31 corresponding thereto from the open end of the recess 31. Each of the end members 210 has the first end 212 thereof contacting the closed end of the recess 31 corresponding thereto and the second end 213 thereof stopped by the ball 33 in the recess 31 corresponding thereto as shown in FIG. 4. It is to be noted that when the ceiling fan is operated, the eccentric force will firmly engage the end members 210 with the tapered recesses 31 and the balls 33 provide a basic positioning function for the end members 210.

Figure 5:
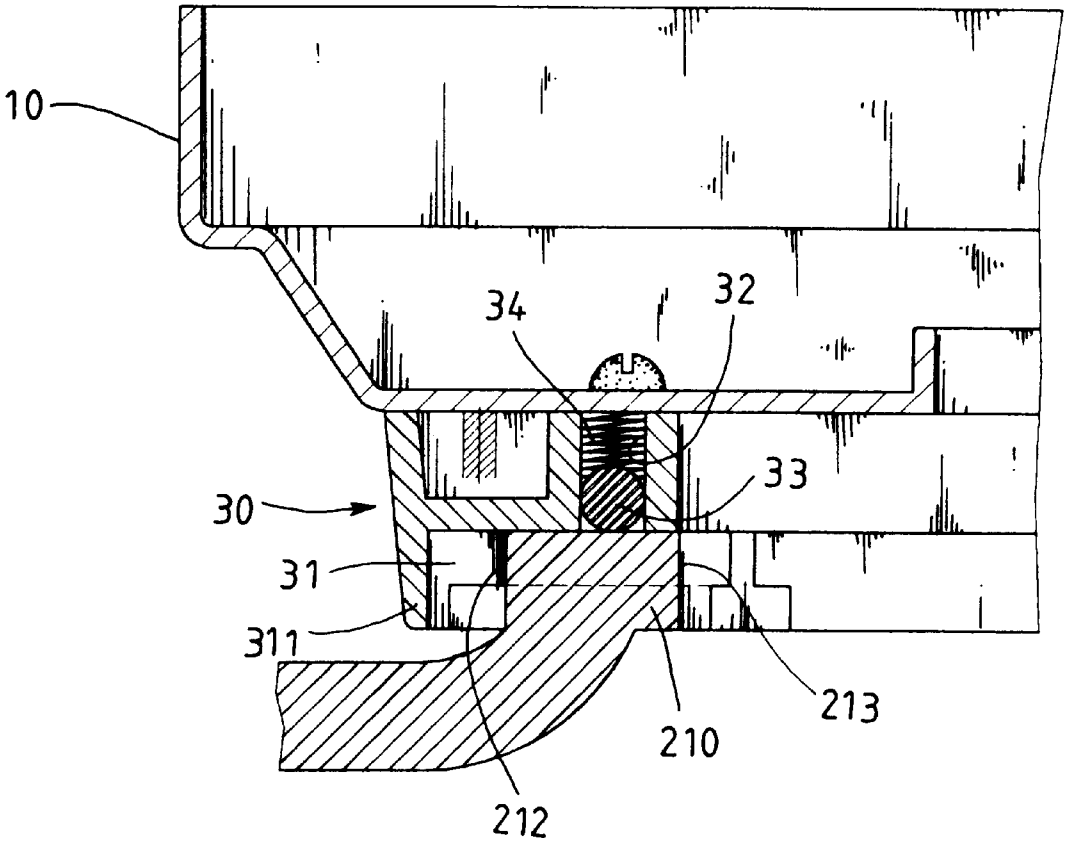
FIG. 5 is a side elevational view, partly in section, of the fan blade bracket to be pulled from the recess of the engaging ring in accordance with the present invention.
Figure 6:
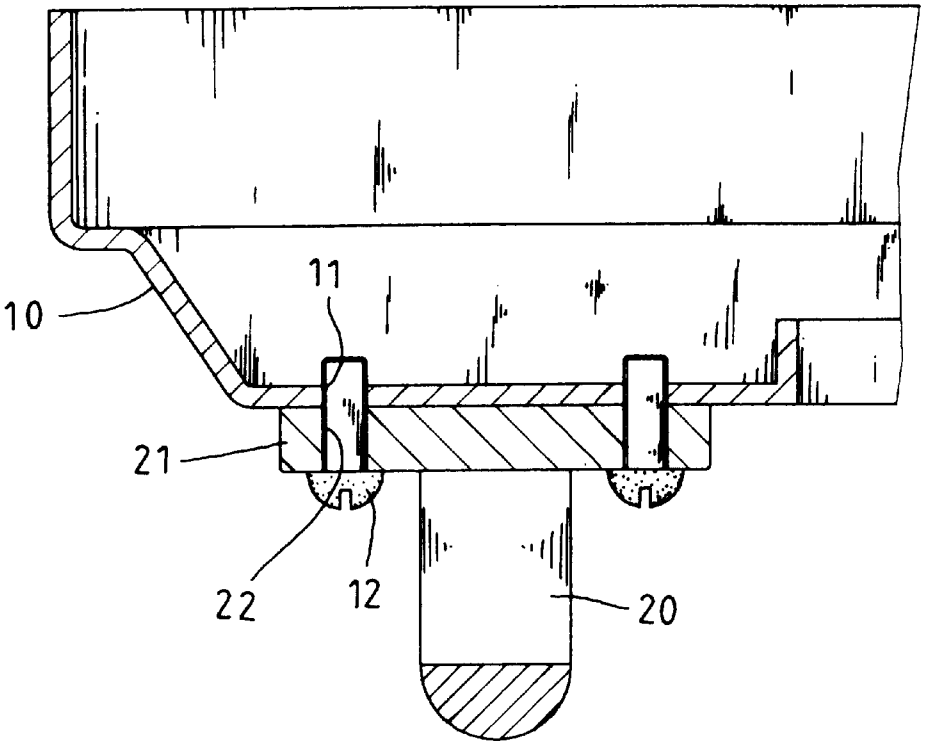
FIG.6 PRIOR ART
FIG. 6 is a side elevational view, partly in section, of the engagement of the conventional fan blade bracket and the motor casing.

Referring to FIG. 5, when the fan blade bracket 21 is to be removed from the recesses 31 of the engaging ring 30, the operators simply pull the end members 210 radially toward the open end of the recesses 31 to push the balls 33 to be received in the apertures 32 to remove the end members 210 from the recesses 31.

By the engagement of the present invention, the assembling time and the disassembling time of the fan blade brackets 21 and the engaging ring 30 is effectively reduced.

The invention is not limited to the above embodiment but various modification thereof may be made. It will be understood by those skilled in the art that various changes in form and detail may made without departing from the scope and spirit of the present invention.

What is claimed is:

1. A ceiling fan comprising:

a motor casing;

an engaging ring connected to the bottom of said motor casing, said engaging ring having a plurality of recesses defined in the bottom thereof and each of said recesses having an open end defined in the inner periphery of said engaging ring and a closed end on the outside of said engaging ring, each of said recesses having a groove defined in a respective one of the two sides thereof, a plurality of apertures defined through said engaging ring and respectively communicating with said respective recesses;

each of said apertures having a spring and a ball received therein which is biased by said spring, said balls respectively extending into said recesses through said apertures, and a plurality of fan blade brackets each having an end member connected thereto which has a flange extending from a respective one of the two sides thereof so as to be received in said grooves of said recess corresponding thereto, each of said end members having a first end thereof contacting said closed end of said recess corresponding thereto and a second end thereof stopped by said ball in said recess corresponding thereto.

2. The ceiling fan as claimed in claim 1, wherein each of said recesses is a tapered recess.

3. The ceiling fan as claimed in claim 1, wherein said springs are urged between said balls and the bottom of said motor casing.

* * * * *